United States Patent [19]

Mochizuki et al.

[11] 4,411,710

[45] Oct. 25, 1983

[54] METHOD FOR MANUFACTURING A STRANDED CONDUCTOR CONSTITUTING OF INSULATED STRANDS

[75] Inventors: Masataka Mochizuki, Tokyo; Michio Takaoka, Chiba; Tsuneaki Moutai, Yachio; Shotaro Yoshida; Kazuo Watanabe, both of Tokyo, all of Japan

[73] Assignee: The Fujikawa Cable Works, Limited, Tokyo, Japan

[21] Appl. No.: 328,592

[22] PCT Filed: Apr. 2, 1981

[86] PCT No.: PCT/JP81/00076

§ 371 Date: Nov. 23, 1981

§ 102(e) Date: Nov. 23, 1981

[87] PCT Pub. No.: WO81/02944

PCT Pub. Date: Oct. 15, 1981

[30] Foreign Application Priority Data

Apr. 3, 1980 [JP] Japan ..... 55-43724
Apr. 3, 1980 [JP] Japan ..... 55-43725

[51] Int. Cl.[3] ..... C23C 1/08

[52] U.S. Cl. ..... 148/6.14 R; 148/6.27; 427/350; 427/434.7; 427/434.6; 118/DIG. 19; 118/419

[58] Field of Search ..... 148/6.14 R, 6.27; 427/434.7, 350, 434.6, 295; 174/110 A; 118/DIG. 19

[56] References Cited

U.S. PATENT DOCUMENTS 1,137,986 5/1915 Kuttner ..... 148/6.27
1,904,162 3/1963 Milliken ..... 174/110 A
3,733,216 5/1973 Goldman ..... 427/434.7
4,325,750 4/1982 Takaoka ..... 174/110 A

FOREIGN PATENT DOCUMENTS 287503 2/1929 United Kingdom ..... 174/110 A
711460 6/1954 United Kingdom ..... 174/116

*Primary Examiner*—Sam Silverberg
*Attorney, Agent, or Firm*—Frishauf, Holtz, Goodman & Woodward

[57] ABSTRACT

A method is disclosed in which an insulating film of an oxide of metal, of which a stranded conductor (30) is made, is formed on the surface of all strands in a stranded conductor, while the stranded conductor is held in the stranded form. In a step of oxidation-treating the strands of an electric cable the pressure of an oxidation treatment solution at the outer portion of the stranded conductor immersed therein is made higher than the pressure in the inner portion of the stranded conductor (30), causing the oxidation treatment solution (48) to be adequately penetrated from the outer portion into the inner portion of the stranded conductor to permit a desired oxide film to be formed on the surface of all the strands in the stranded conductor. In order to more facilitate the penetration of the oxidation treatment solution (48) wholly into the interior of the stranded conductor (30) and the more facilitate an oxidation reaction, vibrations are, in addition to this method, imparted to the stranded conductor (30) in the oxidation treatment step (40) to cause the untwisting of the stranded conductor (30) to be effected to some extent, while the stranded conductor being heated is entered into this step.

25 Claims, 19 Drawing Figures

METHOD FOR MANUFACTURING A STRANDED CONDUCTOR CONSTITUTING OF INSULATED STRANDS

BACKGROUND OF THE INVENTION

This invention relates to a method for manufacturing a stranded conductor constituting of insulated strands in which an oxide of metal, of which the strands are made, is formed on the surfaces of all the electroconductive strands in an electroconductive conductor and more particularly to a method for forming an electrically insulating layer in a stranded state on the surface of all the strands of the electroconductive conductor.

An increase in power transmission voltage and an increase of the current carrying capacity become prominent so as to cope with a recent increase in power transmission capacity in a power transmission system, and a conductor size of 3,000 to 6,000 $mm^2$ has been put into practical use. If in this way the conductor size is increased, an alternating current loss is markedly increased dependent upon the influence of the skin effect and proximity effect. To slove this problem, it is known to provide segmental conductors (normally four to eight) into which a stranded conductor is divided with the respective segment electrically insulated from each other. It is also known to provide a stranded conductor made of insulated strands having an electrically insulating film. It is known that the stranded conductor made of all electrically insulated strands is smaller in its AC effective resistance than the above-mentioned segmental conductor.

A method for the manufacture of a conductor made of electrically insulated strands includes a method for providing a strand by forming an electrically insulating layer around the respective strands and twisting the strands and a method for twisting bare strands to provide a conductor and for forming an electrically insulating layer on the respective bare strands.

Where the electrically insulating layer is an enamel coating, the manufacturing method is restricted to the former method, but if the electrically insulating layer is an oxide film of metal, of which the strand is made, such as copper or aluminium, either method may be used.

In the method of forming a conductor with an electrically insulating layer formed on the strands, a plurality of strands pass in parallel and an electrically insulating layer is formed around the strands, whereby the manufacturing efficiency is enhanced. If the conductor size is 3,000 to 6,000 $mm^2$, the numbers of strands required will be about 500 to 1,000. If the formation of the electrically insulating layer is achieved for a short time, it is necessary to increase the number of equipment. Where the number of equipment is smaller, a longer time is required. In order to make the outer diameter of the conductor of such a larger size as small as possible, a compact-stranded conductor is sometimes used. In such conductor, the strands are twisted with an insulating layer formed thereon to provide a conductor. If such conductor is compacted, the insulating layer of the respective strand is damaged and the insulating effect of the conductors is decreased. Thus, this method cannot be considered to be adopted.

In a method for forming a stranded conductor and then forming an electrically insulating layer on all the strands, the respective strands are exposed in an oxidizing atmosphere (gas or liquid) with the stranded state. In this case, it is easy to subject the outer surface portion of the strand to oxidation treatment. However, difficulty is encountered in effecting adequate oxidation treatment up to the central portion of the conductor. In order to solve such difficulty, a method is known which imparts an undulating bending at the oxidation treatment section to the passing strand or imparts slight untwisting to the stranded conductor to permit interstices to be left between the adjacent strands in the stranded conductor. In this method, an oxidation treatment solution is prevented from penetrating up to the central portion of the stranded conductor by air present or left among interstices of strands at the central portion of the stranded conductor or by a degreasing treatment solution penetrating at a degreasing treatment step before the oxidation treatment step. This method, however, does not assure a positive formation of an adequate oxidation film on the inner strands in the stranded conductor.

An object of this invention is to positively form an oxidation film having an adequate electrical insulation on the outer portion of a stranded conductor or the surface of the strands present in the central portion of the stranded conductor.

Another object of this invention is to permit an oxidation treatment solution to be readily penetrated without preventing the oxidation treatment solution from being penetrated during the oxidation treatment step into the interstices of the strands in the inner portion of the stranded conductor by the presence of air left in the inner portion of the stranded conductor before the stranded conductor is done with the oxidation treatment step, or by the presence of a degreasing treatment solution left penetrated in the inner portion of the stranded conductor in the degreasing step before the oxidation treatment step.

Another object of this invention is to make the oxidation reaction of the surface of the strand more effective by not only flowing an oxidation treatment solution in the radial direction of the stranded conductor, but also flowing it along the interstices of the stranded conductors.

SUMMARY OF THE INVENTION

This invention relates to a method of manufacturing a stranded conductor in which an electrically insulating layer is formed on the surface of all the strands, the electrically insulating layer being an oxide film of metal of which the strands are made, and in particular a method of manufacturing a stranded conductors constituted of strands, in which in a step for subjecting the conductive strand for an electrical cable to an oxidation treatment in the stranded state an external pressure on the stranded conductor immersed with an oxidation treatment solution is higher than a pressure in the inner portion of the stranded conductor, causing the oxidation treatment solution to be adequately penetrated from the outer portion to the inner portion of the stranded conductor to form a desired oxide film on the surface of all the strands of which the conductor is made. In addition to this method, another method is used which, in order to more facilitate immersion of all the inner portion of the stranded conductor with the oxidation treatment solution and more facilitate the oxidation reaction, imparts vibrations to the stranded conductor in the oxidation treatment solution step to cause the stranded conductor to be untwisted to some extent, while in this step the stranded conductor being heated passes.

BRIEF DESCRIPTION OF DRAWINGS

FIG. 4 shows the above-mentioned fundamental method in which a pressure applying means is provided on the side at which an oxidation treatment solution is supplied; FIG. 5 shows the case where a suction means is provided on the side at which the oxidation treatment solution is discharged; FIG. 6 shows the case where the pressure applying means and suction means are used in combination; FIG. 7 shows another method of this invention in which in addition to the fundamental method of FIG. 3 vibrations are imparted to the stranded conductor in the oxidation treatment step; FIG. 8 shows another method of this invention in which in addition to the fundamental method of FIG. 3 the stranded conductor being exposed to the oxidation treatment step undergoes untwisting; FIG. 9. shows another method of this invention in which the oxidation treatment step is divided into first and second sections, the pressure of the oxidation treatment solution in the first section being greater than the pressure of the oxidation treatment solution in the second section; FIG. 10 shows another method of this invention in which in the fundamental method of FIG. 3 a preheated strand is done with into the oxidation treatment step;

DETAILED DESCRIPTION

Figure 1A:
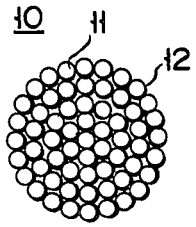
FIG. 1 shows a round conductor with insulated strand, FIG. 1*a* being a cross-sectional view and FIG. 1*b* a front view.
Figure 1B:
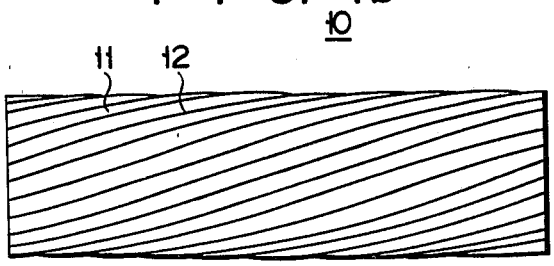
Figure 2A:
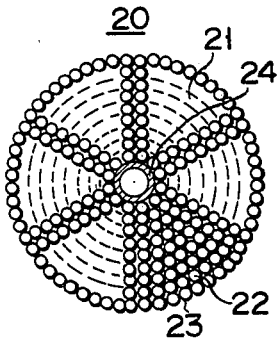
FIG. 2 shows a segmental conductor with insulated strand for an OF cable which is divided into six segments which are round compact-stranded, FIG. 2*a* being a cross-sectional view and FIG. 2*b* a front view showing one segment as indicated by solid lines.
Figure 2B:
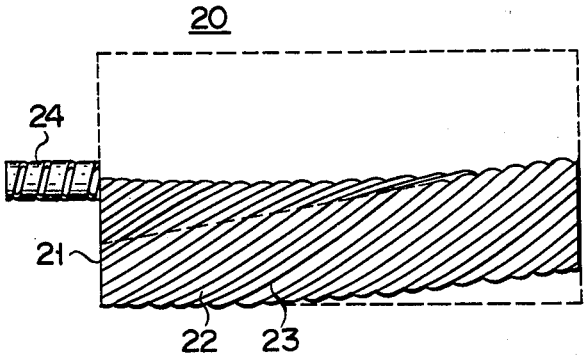

FIGS. 1 and 2 show a stranded conductor as manufactured according to the method of this invention. FIG. 1 shows a stranded conductor of circularly twisted conductors 10 in concentric array and 11 shows an electroconductive strand made of, for example, copper and aluminium. 12 shows an electrically insulating oxide film, such as cupric oxide CuO and aluminium oxide, formed on the surface of the strand 11, it being desired that the thickness of the film be 0.5 to 10 μm.

FIG. 2 shows a 6-segmental compact-stranded conductor 20 used as the conductor for OF cables. 21 shows its conductor segment; 22, its electrically conductive conductor; 23, an electrically insulating oxide film formed on the surface of the strand 22; and 24, a metal spiral as an oil passage. An oxide film 23 is formed on the surface of the strands in the segment 21 of the stranded conductor 20. Six conductor segments 21 are twisted around the metal spiral body 24 into a circular outer configuration with the body 24 as a center to provide a stranded conductor 20.

The manufacturing method of this invention will be explained by referring to FIGS. 3 and 10.

Figure 3:
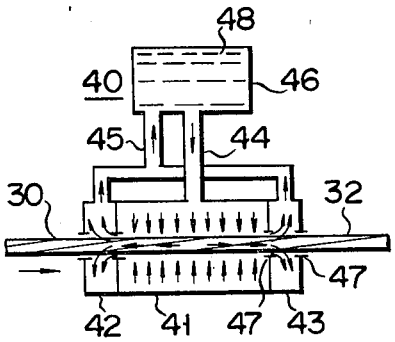
FIGS. 3 to 10 are a principle diagram showing various examples of a manufacturing method of this invention, FIG. 3 showing a fundamental method of this invention in which in an oxidation treatment step the pressure of an oxidation treatment solution on the outer portion of the stranded conductor immersed therewith is higher than the pressure of the oxidation treatment solution in the inner portion of the stranded conductor, causing the oxidation treatment solution to be penetrated from the outside to the inside of the stranded conductor to permit the oxidation treatment solution to be discharged to the outside of the stranded conductor after the oxidation treatment solution is flowed into the interstices in the stranded conductors.

FIG. 3 shows a fundamental example of the manufacturing method of this invention. 30 shows the standed conductor on which no oxide film is formed on the surface of the strands; 40, an oxidation treatment step, and 32, a stranded conductor subjected to the oxidation treatment step, an oxide film being formed on the surface of its strands. The oxidation treatment step 40 includes an oxidation treatment chamber 41 and oxidation treatment solution discharge chambers 42 and 43 adjacently defined before and after the oxidation treatment chamber. The oxidation treatment chamber 41 is connected by a supply tube 44 to an oxidation treatment solution bath 46 and the discharge chambers 42 and 43 are connected by a return pipe 45 to the oxidation treatment solution. Sealing devices 47 are provided at those locations of the chambers 42, 41 through which the stranded conductor (30, 32) passes. By so doing, the oxidation treatment solution 48 is prevented from being discharged from the oxidation treatment chamber 41 through the outside of the surface of the stranded conductor 30 into the discharge chambers 42 and 43 to a maximum possible extent. The oxidation treatment solution is discharged through the interstices of the twisted strands in the stranded conductor 30 or 32. The sealing device 47 will be explained below in more detail. The stranded conductor 30 passes in the order of the discharge chamber 42, oxidation treatment chamber 41 and discharge chamber 43. The oxidation treatment solution 48 is supplied from the oxidation treatment solution bath 46 through the supplying pipe 44 to the oxidation treatment chamber 41 where the stranded conductor 30 is immersed in the oxidation treatment solution 48. The pressure in the oxidation treatment chamber 41 is maintained, by later described various means, higher than the pressure in the discharge chambers 42 and 43, whereby in the oxidation treatment chamber 41 the pressure in the outer portion of the stranded conductor 30 is maintained higher than the pressure of the inner portion of the stranded conductor. Thus, the oxidation treatment solution 48 is penetrated from the outer portion into the inner portion of the stranded conductor. The oxidation treatment solution 48 flows from the oxidation treatment chamber 41 through the interstices in the twisted strands in the stranded conductor into the discharge chambers 42 and 43 and discharged from the interstices in the twisted strands to the outer portion of the stranded conductor 30 or 32 in the discharge chambers 42 and 43. Since in this case the sealing device 47 is provided between the oxidation treatment chamber 41 and the discharge chambers 42 and 43, the discharge of the oxidation treatment solution 48 along the outer surface of the stranded conductor (30, 32) is prevented to a maximum possible extent. However, such discharge must be allowed to some extent. This is because, if such discharge is more decreased, a frictional resistance is increased with respect to the stranded conductor (30, 32) in the sealing device 47. The oxidation treatment solution 48 is returned from the discharge chambers 42 and 43 through he return pipe 45 into the oxidation treatment bath 46. In this way, the stranded conductor 30 is immersed in the oxidation treatment solution in the oxidation treatment chamber 41. The oxidation treatment solution 48 is penetrated from the outer portion into the inner portion of the stranded conductor 30, flowed through the interstices of the twisted strands and discharged toward the outer portion of the stranded conductor (30, 32) in the discharge chambers 42 and 43. As a result, an adequate oxide film is positively formed on the surfaces of the strands in the outer and inner layers of the stranded conductor 30.

Figure 6:
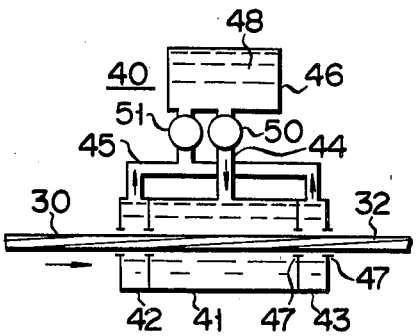

In connection with FIGS. 4 and 6, an explanation will be given of the embodiment in which the preasure in the oxidation treatment chamber 41 is maintained higher than that in the discharge chambers 42 and 43.

Figure 4:
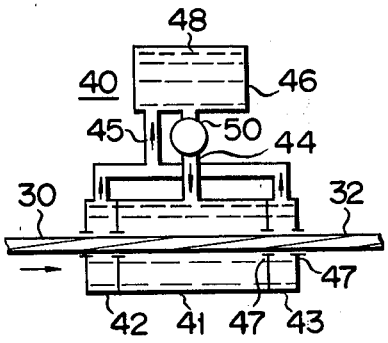
Figure 5:
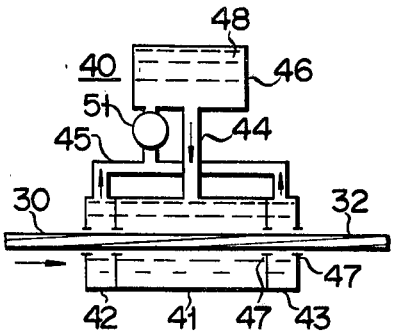

FIG. 4 shows the case where a pressure applying pump 50 is provided on the supply pipe and an oxidation treatment solution 48 under pressure is supplied into the oxidation treatment chamber 41. FIG. 5 shows the case in which a suction or vacuum pump 51 is provided on the return pipe 45 and the oxidation treatment solution 48 is the oxidation treatment chamber 41 is sucked from the discharge chambers 42 and 43 through the interstices of the twisted strands in the stranded conductor (30, 32). FIG. 6 shows the case where the pressure applying pump 50 and suction or vacuum pump 51 as shown in FIGS. 4 and 5, respectively, are used in combination. Here, a difference between the pressure in the oxidation treatment chamber 41 and the pressures in the discharge chambers 42 and 43 may be 0.1 to 3 $Kg/cm^2$, but is not restricted to this range. This value is determined taking into consideration of a pressure-resistant equipment cost and structure of the stranded conductor to be applied (the penetration of the oxidation treatment solution into the inner portion of the strand). As the oxidation treatment solution 48 use is made of an aqueous solution, such as sodium chlorite NaClO and sodium hypochlorite $NaClO_2$, which is well known as an oxidizing agent; as an oxidizing assistant use is made of a sodium hydroxide (NaOH) aqueous solution; as an oxidizing agent use is made of a hydrogen peroxide aqueous solution, and as an oxidizing assistant use is made of, for example, sulfuric acid $H_2SO_4$ and nitric acid $HNO_3$, but this invention is not restricted to these. In order to more facilitate the penetration of the oxidation treatment solution into the inner portion of the stranded conductor and facilitate an oxidation reaction, the temperature of the oxidation treatment solution may be heated to its boiling point or its neighborhood. Where hydrogen peroxide is used, it is desirable to heat it to below the decomposition temperature, for example, below 50° C. The stranded conductor 32 of insulated strands so formed is washed, the oxidation treatment solution is removed, and the stranded conductor is, after dried, wound.

Upon reference to FIGS. 7 to 10 an explanation will be made of the embodiment whereby the formation of an oxide film on the conductors in the inner layer of the stranded conductor is more positively formed as a basis of the above-mentioned manufacturing method.

Figure 7:
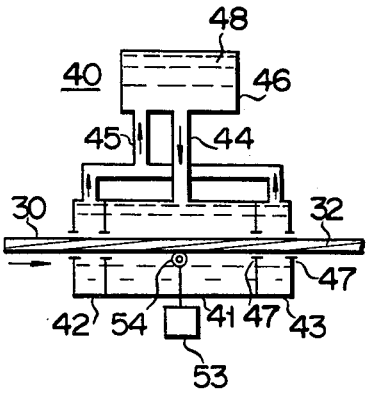

FIG. 7 shows the case where vibrations are imparted to the stranded conductor 30 in the oxidation treatment step 40. 53 shows a vibration generating device and 54 is a vibration applying element. In the Figure, the vibration element 54 imparts vibrations to the stranded conductor 30 through direct contact with the strand. Vibrations may be propagated to the stranded conductor 30 with the element 54 in contact with the oxidation treatment solution 48 or the oxidation treatment chamber 41. A frequency to be given may be in a range from an ultra wave to a low frequency wave below a commercial frequency, but is not restricted thereot. The frequency may exceed this range. By applying vibrations to the stranded conductor 30 a contacting relation between the adjacent strands in the stranded conductor 30 is broken to permit ready penetration of the oxidation treatment solution 48 into the interstices of the twisted strands. Air retained in the small interstices of the twisted strands or a degreasing solution penetrated in a degreasing step preceding the oxidation treatment step is readily removed from the surface of the strand by applying vibrations. As a result, the air and degreasing solution, together with the oxide treatment solution 48 flowing through the interstices of the strands, are directed frm the interstices of the strands toward the outer portion of the stranded conductor (30, 32) in the discharge chambers 42 and 43, more positively facilitating the oxidation reaction on the surface of all the strands of which the stranded conductor 20 is made. Where given vibrations are in an ultrasonic wave region, an active molecular motion occurs, more promoting the oxidation reaction.

Figure 8:
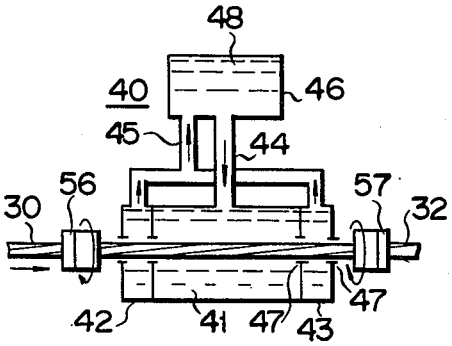

FIG. 8 shows the case where, through the untwisting of the stranded conductor 30 in the oxidation treatment step, interstices are formed between the adjacent strands thereby facilitating the penetration of the oxidation treatment solution 48 from the outer portion to the inner portion of the strand. 56 and 57 are untwisting means provided before and after the oxidation treatment step 40. The untwisting should be performed within the elastic limit of the strands in the conductor.

Figure 9:
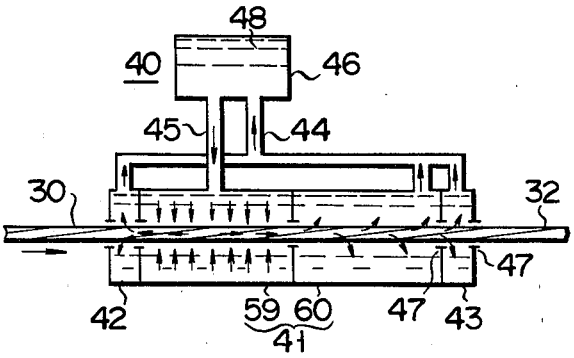

FIG. 9 shows the case where an oxidation treatment chamber 41 is partitioned into two chambers 59 and 60 and the pressure of the oxidation treatment solution in the first oxidation treatment chamber 59 is maintained higher than the pressure of the oxidation treatment solution in the second oxidation treatment chamber 60. When the conductor strand 30 passes in the order of the first oxidation treatment chamber 59 and second oxidation treatment chamber 60 while being immersed in the oxidation treatment solution, the pressure of the oxidation treatment solution is lowered in the order of the outer portion and inner portion of the stranded conductor 30 in the first oxidation treatment chamber 59 and then the inner portion and outer portion of the stranded conductor in the second oxidation treatment chamber. In that order, the oxidation treatment solution 48 flows. The oxidation reaction proceeds such that in the first oxidation treatment chamber 59 the surface of the conductors present in the outer layer of the stranded conductor is oxidized earlier than the surface of the strands present in the inner layer of the stranded conductor and that in the second oxidation treatment chamber 60 the surface of the conductors present in the inner layer of the strand is oxidized earlier than the surface of the strands present in the outer layer of the stranded conductor. In this way, the stranded conductor is subjected to an oxidation treatment in each chamber and a uniform oxide film is formed over the inner and outer layers of the strand.

Figure 10:
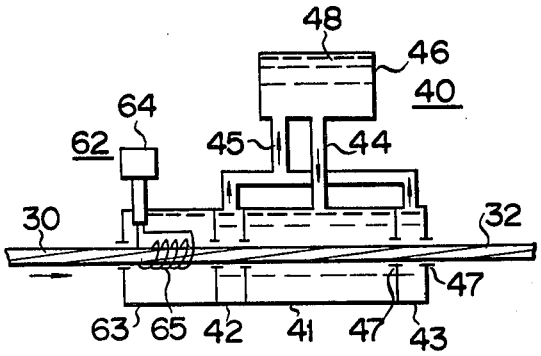

FIG. 10 shows the case where a heated stranded conductor is penetrated into an oxidation treatment step 40. 62 is heating means which is disposed at a location immediately before the oxidation treatment step 40. In this Figure, a high-frequency induction heating is shown. 63 shows a heating chamber provided adjacent to, and immediately before, the discharge chamber 42; 64 shows a high-frequency current generator and 65 shows a coil for induction heating. As a heating means use is made of, for example, induction heating, heating by an electric heater and heating by a reducing gas flame. The heating of the stranded conductor 30 by the heating means 62 is desirably in a range of 100° to 350° C. When the stranded conductor 30 is so exposed to a high temperature, the interstices of the twisted conductors become greater due to the thermal expansion, causing interstices to the created between the adjacent strands. Through the interstices the oxidation treatment solution 48 is readily penetrated up to the inner layer of the strand 30. Even if the degreasing solution is left in the inner portion of the stranded conductor 30, it is gasified in the heating chamber 63. When the high-temperature stranded conductor 30 passes into the oxidation treatment chamber 41 where it is exposed to the oxidation treatment solution 48, the oxidation treatment solution 48 is gasified and the gas is jetted into the discharge chamber 42. The degreasing solution tends to be discharged from the inner portion of the stranded conductor 30 and the oxidation reaction of the strands in the stranded conductor 30 is not prevented by the degreasing solution. A gasified zone at the interstices of the twisted strands is entered through the oxidation treatment chamber 41 and quickly chilled and condenced. This causes the volume reduction and as a result of sucking the oxidation treatment solution from the outer portion to the inner portion of the stranded conductor 30 the oxidation treatment solution permits ready penetration more into the interior of the stranded conductor 30. Furthermore, the high temperature of the stranded conductor 30 and oxidation treatment solution more facilitates the oxidation reaction. Thus, an adequate oxide film is positively formed over the strands in the inner and outer layers of the strand.

Figure 11A:
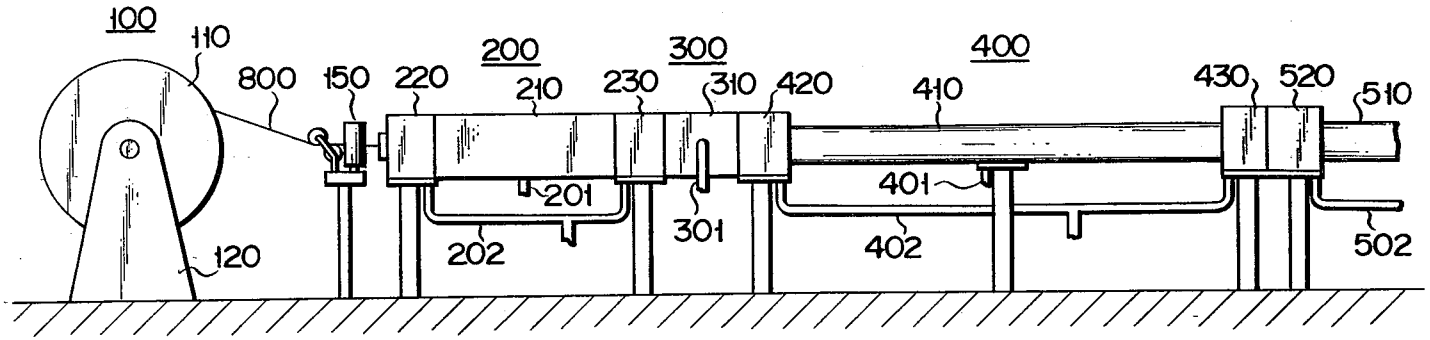
FIG. 11 is a front view showing an actual manufacturing equipment utilizing the method of this invention, the right end of FIG. 11*a* being continuous with respect to the left end of FIG. 11*b*, the right and left ends of FIGS. 11*a* and 11*b* being duplicated to some extent due to the FIG. 11 being divided.
Figure 11B:
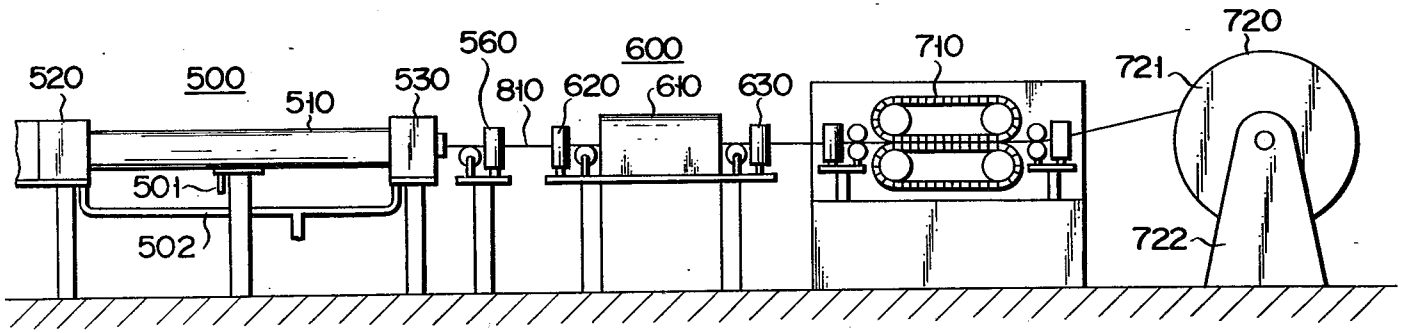
Figure 12A:
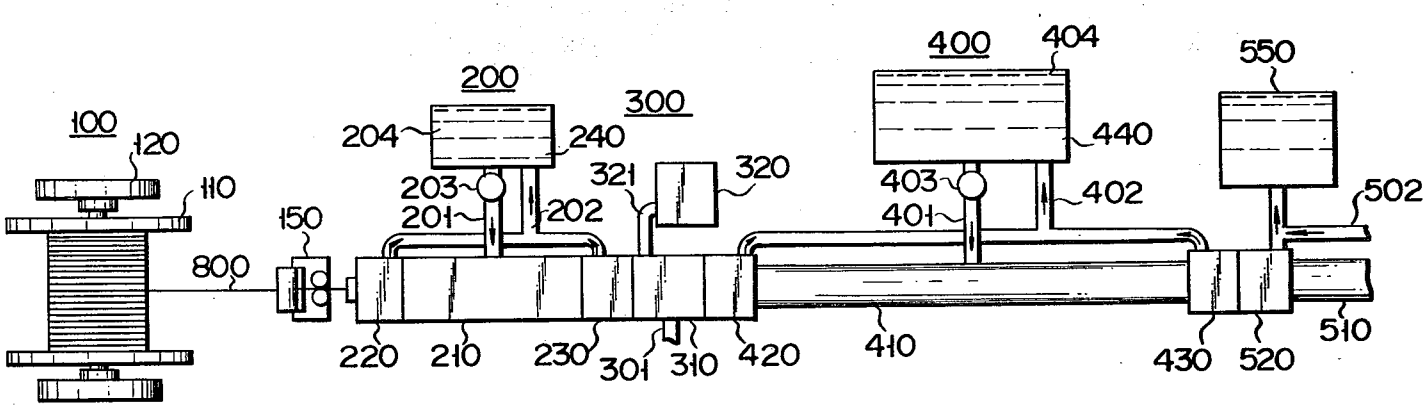
FIG. 12 is a plan view showing a manufacturing equipment as shown in FIG. 11, FIGS. 12*a* and 12*b* being drawn to correspond to FIGS. 11*a* and 11*b*.
Figure 12B:
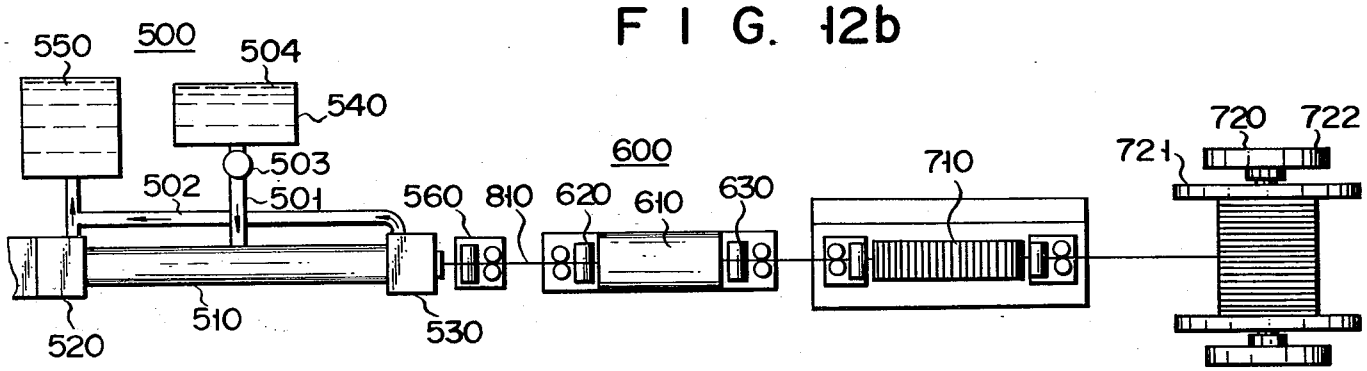

Upon reference to FIGS. 11 and 12 an explanation is given of the embodiment on the conductive strand manufacturing line using the method of this invention. 100 shows a pay off stand; 200, a degreasing device; 300, a heating device; 400, an oxidation treatment device; 500, a washing device; 600, a drying device; 710, a pickup stand; and 720 a take up stand. A bare copper strand 800 is delivered from the delivery device 100 and passed through the degreasing device 200, heating device 300 and oxidation treatment device 400 where it becomes an insulated conductor strand 810. The strand passes through the drying device, picked up by the pickup device 710 and finally wound on the takeup device 720.

The pay off stand 100 comprises a drum 110 wound with a bare copper strand and a support base 120 for supporting the drum 110 such that it can be freely rotated. The bare copper stranded conductor 800 delivered from the drum 110 passes into a degreasing device 200 through a guide device 150. The degreasing device 200 comprises a degreasing chamber 210, discharge chambers 220 and 230 at each end of the degreasing chamber 210, degreasing solution bath 240, supply pipe 201 connecting, by a fluid supply pump 203, between the degreasing solution bath 240 and the degreasing chamber 210, and a return pipe 202 connecting between the degreasing solution bath 240 and the discharge chambers 220 and 230. The base copper stranded conductor 800 passes through the discharge chamber 220, degreasing chamber 210 and discharge chamber 230 in that order. The degreasing solution 204 is supplied by the supply pump 203, from the degreasing solution bath 240 to the degreasing chamber 210 through the supply pipe 210. Animal and vegitable oil or mineral oil attached to the bare copper stranded conductor 800 is removed by causing the stranded conductor to be immersed in the degreasing solution 204 in the degreasing chamber 210. At this time, the dust, copper powder etc. attached to the stranded conductor 800 are washed and removed. The degreasing solution 204 is discharged from the degreasing chamber 210 into the discharge chambers 220 and 230 and returned to the degreasing solution bath 240 through the return pipe 202 . As the degreasing solution 204 for removing the mineral oil use may be made of toluene or trichloroethane and as the degreasing solution for removing the animal and vegetable oil use may be made of a sodium hydroxide soluion. A sealing device (not shown) is provided at the inlet through which the bare copper stranded conductor 800 passes into the discharge chamber 220, at that through bore portion of a partition wall between the degreasing chamber 210 and the discharge chambers 220 and 230 and at the outlet portion from the discharge chamber 230. At the inlet and outlet, an outward flow of the degreasing solution is prevented. At both the ends of the degreasing chamber 210 the discharge of the degreasing solution 204 from the surface of the stranded conductor 800 into the discharge chambers 220 and 230 is prevented to a maximum possible extent, and the degreasing solution 204 is discharged from the degreasing chamber 210 into the discharge chambers 220 and 230 through interstices of the twisted strands in the stranded conductor 800. Thus, the adequate degreasing of the strand is positively effected over the inner and outer layer portions of the stranded conductor. The sealing device will be set out below in more detail.

The stranded conductor 800 passed through the degreasing device 200 enters through the heating device 300. The heating device 300 comprises a heating chamber 310 which is continuous with respect to the discharge chamber 230 in the degreasing device 200 and which is shut off from the outer atmosphere, high-frequency induction heating device 320, lead 321 permitting an electrical connection to be made between the high-frequency induction heating device and an induction heating coil arranged in the heating chamber 320, and a vapor supply pipe 301 for filling the heating chamber 310 with, for example, a vapor to maintain the interior of the heating chamber 310 always in an inert atmosphere. The stranded conductor 800 is heated to about 180° C. in the heating chamber 310. Here, the reason why the interior of the heating chamber 301 is held at the inert atmosphere is because, if the stranded conductor 800 is exposed to the air, an undesirable cuprous oxide $Cu_2O$ is formed on the surface of the strands in the stranded conductor 800. The cuprous oxide $Cu_2O$ film is prominently mechanically weak and chemically inert in comparison with the cupric oxide CuO film.

The stranded conductor 800 passed through the heating device 300 is then introduced into the oxidation treatment device 400. The oxidation treatment device 400 comprises an oxidation treatment chamber 400, discharge chambers 420 and 430 before and after the oxidation treatment chamber 410, oxidation treatment solution bath 440, supply pipe 401 connecting the oxidation treatment solution bath 440 by a pressure applying pump 403 to the oxidation treatment chamber 410, and return pipe 402 for connecting the oxidation treatment solution bath 440 to discharge chambers 420 and 430. The discharge chamber 420 and the above-mentioned heating chamber 310, and discharge chamber 430 and discharge chamber 520 in a later-described device 500 for washing with water, are respectively continuous. The respective chambers of the heating chamber 310, discharge chamber 420, oxidation treatment chamber 410, discharge chamber 430 and water discharge chamber 520 are partitioned by partition walls, and the sealing device is provided at the stranded conductor penetrating portions of the chambers. The sealing device will be described below in more detail. As the oxidation treatment solution 404 use is made of a 1:1 mixed solution i.e. a 5 weight % sodium hypochlorite NaClO aqueous solution as an oxidizing agent and 5 weight % sodium hydroxide aqueous solution as an oxidizing assistant. The oxidation treatment solution 404 is made at a temperature of 95° C. and supplied, by a pressure applying pump 403, through the suppling pipe 401 into the oxidation treatment chamber 40 where the pressure of the solution 404 is held at a gage pressure of 0.3 $Kg/cm^2$. The pressure of the discharge chambers 420 and 430 is equal to the atmospheric pressure. Thus, the oxidation treatment solution 404 is penetrated from the outer portion to the inner portion of the stranded conductor 800 at the oxidation treatment chamber 410 and, in the discharge chambers 420 and 430, discharged from the inner portion to the outer portion of the stranded conductor through the interstices of the twisted conductors in a stranded conductor 800. At the same time, the oxidation treatment solution 404 is discharged from between the outer surface of the stranded conductor 800 and the sealing device into the discharge chambers 420 and 430. The discharged oxidation treatment solution 404 is returned to the oxidation treatment flow bath 440 through the return pipe 402. Thus, a cupric oxide CuO film is formed on the surface of all the conductors in the stranded conductor 800, providing a stranded conductor 810. The stranded conductor 810 pass through the oxidation treatment device 400 is then introduced into a device 500 for washing with water. The device 500 comprises a chamber 510 for washing with water, discharge chambers 520 and 530 which are continuous before and after the chamber 510, supply pipe 50 for permitting connection to be made, by a pressure applying pump, between a water bath 540 and as waste water treatment bath 550 and between the water bath 540 and the washing chamber 510, and a return pipe 502 for connecting the waste water treatment bath 550 to the discharge chambers 520 and 530. The water discharge chamber 520 is continuous with respect to the discharge chamber 520, and the respective chambers of the discharge chamber 430, water discharge chamber 520, chamber 510 for washing with water and discharge chamber 530 are partitioned by partition walls and the respective sealing device is provided in the penetrating portions of the respective chambers. The sealing device will be set out later in more detail. Water 504 is flowed, by a pressure applying pump 503, from the water bath 540 through the supply pipe 501 into the chamber 510 where the water pressure is held at a gage pressure of 0.3 $Kg/cm^2$. The interior of the discharge chambers 520 and 530 is made equal to the atmospheric pressure. The water 504 in the chamber 510 is discharged from the interior of the stranded conductor 810 to the discharge chambers 520 and 530 in the water discharge chambers 520 and 530, through between the outer surface of the stranded conductor 810 and the sealing chamber and through the interstices of the strands in the conductor and discharged into the waste water treatment chamber 550 through a return pipe 502. In this way, the stranded conductor 810 passes through the device 500 for washing with water and the oxidation treatment solution attached to the stranded conductor is completely washed and removed.

The stranded conductor 810 washed by the device 500 is introduced into a drying device 600 through a guide device 560. The drying device 600 comprises a drying chamber 610 and guide devices 620 and 630 provided before and after the drying chamber 610. Dried air is heated to 200° C. in the drying chamber 610, blown toward the stranded conductor 810. Water attached to the stranded conductor 810 is completely removed. The stranded conductor 810 is picked up by a pickup device 710 and wound around a takeup device 720 which comprises a support base 722 and drum 721 supported on the support base 722.

Figure 13:
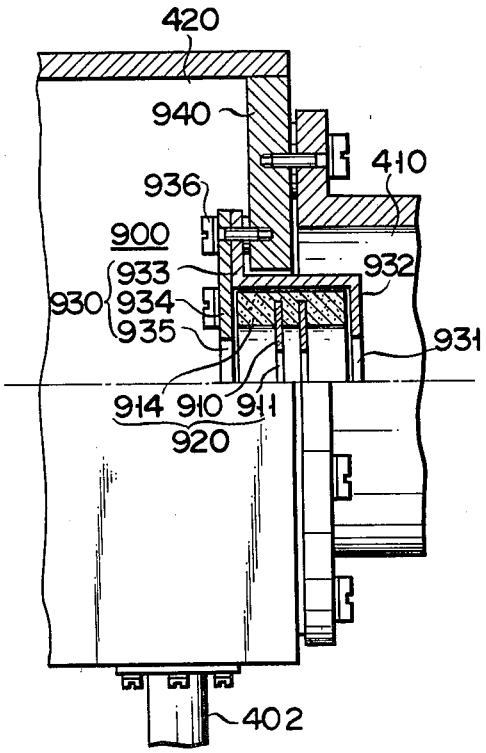
FIG. 13 is a front view, partly in cross-section, showing in FIGS. 11 and 12 a detail of a sealing means at the entrance section through which the conductive strand is entered into an oxidation treatment chamber.
Figure 14A:
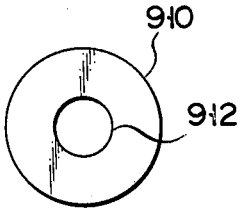
FIG. 14 is a front view showing a sealing device as used in the sealing means of FIG. 13, FIG. 14*a* corresponding to the case of a stranded circularly twisted conductors of FIG. 1 and FIG. 14*b* showing the sealing member suitable to one of six segments into which a compact-stranded conductors are divided.
Figure 14B:
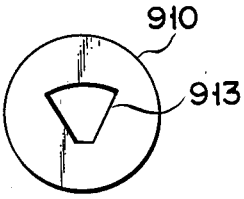

FIG. 13 shows one form of a sealing device 900 as used in a location where a strand 800 is introduced from the discharged chamber 420 in the oxidation treatment device 400 into the oxidation treatment chamber 410. A sealing disc 910 has at the center thereof a hole 911 corresponding to the configuration of the cross-section of the stranded conductor which passes therethrough, for example, a circular hole 912 (see FIG. 14*a*) being provided for a circular strand. For the segment of the 6-segment conductor strand a hole 913 (see FIG. 14*b*) is provided which corresponds to the configuration of the cross-section of the segment. A plurality of circular discs 910, for example, 2 discs (which are determined by the pressure of liquid to be sealed) are fixedly supported at intervals on a cylindrical supporter 914 to constitute a sealing unit 920. 930 shows a case for receiving a sealing member therein and comprises a cylindrical body 933 having a bottom 932 with a hole 931 and a retainer disc 934 disposed at the end opposite to that at which the bottom 932 is provided, the retainer disc 934 having a hole 935. The sealing unit 920 is rotatable around the center axis of the cylindrical body 933. In this way, the cylindrical body 933 of the case 930, into which the sealing unit 920 is received, and retainer disc 934 are fixed by bolts 936 to a partition wall 940 between the discharge chamber 420 and the oxidation treatment chamber 410, thereby constituting a sealing device 900.

The reason why the sealing unit 920 can be rotated in the cylindrical case 930 is because the stranded conductor is made suitably adapted to the segmental conductor. It is also because, in order to twist a predetermined number of segments into a circular conductive strand, twisting corresponding to the strands in the stranded conductor is given. As the segment passes through the sealing device 900, the sealing body 920 is rotated according to twisting. As a material for the sealing disc 910, use may be made of an elastic body, such as a fluorine rubber, which is not attacked by the oxidation treatment solution. In order to provide ready rotation of the sealing body 920 in the cylindrical case 930 it is desirable that, as a material for the cylindrical support 914, cylindrical body 933 and retainer disc, use may be made of a lubricant material such as polytetrafluoroethylene which is not attacked by the oxidation treatment solution, the metal body (as a base) for these members being lined with such material.

Such sealing device 900 is provided at the location between the discharge chamber 420 and the oxidation treatment chamber 410 and at those portions of the respective partition walls through which the stranded conductor passes in the degreasing device 200, heating device 300, oxidation treatment device 400 and device 500 for washing with water.

In the above-mentioned manufacturing line, a 500 $mm^2$ compact-stranded conductor segment (five-segment type) was used for the conductor strand. In the degreasing device 200, the segment was degreased with a 5 weight % sodium hydroxide aqueous solution of 60° C., heated to 200° C. and introduced into an oxidation treatment chamber 410. The conductive strand was oxidation-treated for 3 minutes in the oxidation treatment chamber 410 at the velocity of 1 m/hr with an oxidation treatment solution of 95° C. at a gage pressure of 0.3 $Kg/cm^2$. It has been found that the thickness of the cupric oxide film of the strands in the obtained conductor was about 1.0 μm at the innermost layer and about 1.5 μm at the outermost layer of the conductor.

The present invention provides a method for the manufacture of a conductor for use in a large electric power transmission cable. The present invention is very effective in forming an oxide insulating film of high electrical insulation on each strand.

We claim:

1. A method of manufacturing a stranded conductor (30) comprised of a plurality of insulated strands, comprising:

passing an uninsulated stranded conductor (30) formed of a plurality of uninsulated strands in a stranded state through an oxidation treatment solution (48; 404) in an oxidation chamber (41), while keeping said stranded conductor immersed in said oxidation treatment solution as it passes therethrough; and maintaining the pressure of said oxidation treatment solution (48; 404) at the outer portion of said stranded conductor greater than the pressure of said oxidation treatment solution (48; 404) at the inner portion of said stranded conductor (30) by a sufficient amount such that said oxidation treatment solution flows to the inner portions of said stranded conductor and flows through the interstices amoung each of the strands of said stranded conductor, thereby causing said oxidation treatment solution to discharge from said oxidation chamber by flowing through the interstices of the twisted strands of said stranded conductor into a discharge chamber adjacent said oxidation chamber.

2. A manufacturing method as claimed in claim 1, wherein vibrations are imparted to said oxidation treatment solution (48; 404) and to said strand (30).

3. A manufacturing method as claimed in claim 1, comprising untwisting of said stranded conductor (30) within an elastic limit while passing said stranded conductor through said oxidation treatment solution.

4. A manufacturing method as claimed in claim 3, wherein vibrations are imparted to said oxidation treatment solution (48; 404) and to said stranded conductor (30).

5. A manufacturing method as claimed in claim 1, wherein said step of passing said uninsulated stranded conductor through said oxidation treatment solution includes a first oxidation treatment step and a second oxidation treatment step subsequently effected; wherein in the first and second treatment steps said stranded conductor (30) is passed through said oxidation treatment solution (48; 404), while being immersed therein and the pressure of said oxidation treatment solution (48; 404) at the outer portion of said conductor in said first oxidation treatment step is made greater than the pressure of said oxidation treatment solution (48; 404) at the outer portion of said stranded conductor (30) in said second oxidation treatment step; and wherein in said first oxidation treatment step said oxidation treatment solution (48; 404) is penetrated from the outer portion into the inner portion of said stranded conductor; and in said second oxidation treatment step said oxidation treatment solution (48; 404) is flowed from the inner portion toward the outer portion of said stranded conductor.

6. A manufacturing method as claimed in claim 5, wherein in said first and second oxidation treatment steps (40) vibrations are imparted to said oxidation treatment solution (48; 404) and to said stranded conductor.

7. A manufacturing method as claimed in claim 5 or 6, wherein in said first and second oxidation treatment steps (40) the untwisting of said stranded conductor is effected within an elastic limit.

8. A manufacturing method as claimed in any one of claims 1, 2, 3, 4, 5 or 6, wherein said oxidation treatment solution (48: 404) is heated to its boiling point, or said oxidation treatment solution (48; 404) is heated to a temperature near it or to a temperature near a decomposition temperature of an oxidizing agent in said oxidation treatment solution (48; 404), whichever is lower in the temperature.

9. A manufacturing step as claimed in any one of claims 1, 2, 3, 4, 5 or 6, wherein in said oxidation treatment step (40) said stranded conductor immersed in said oxidation treatment solution (48; 404) is heated.

10. A manufacturing step as claimed in claim 8, wherein in said oxidation treatment step said stranded conductor (30) immersed in said oxidation treatment solution (48; 404) is heated.

11. A manufacturing method as claimed in any one of claims 1, 2, 3, 4, 5 or 6, wherein in said oxidation treatment step said oxidation treatment solution is subjected to pressure in a section where said stranded conductor (30) is immersed in said oxidation treatment solution, said oxidation treatment solution is flowed into the interstices of twisted strands in said stranded conductor, and outside said section said oxidation treatment solution (48; 404) is flowed through the interstices of twisted strands in said stranded conductor.

12. A manufacturing method as claimed in claim 1, further comprising:

providing an oxidation treatment chamber containing said oxidation treatment solution, and through which said uninsulated stranded conductor is passed;

providing oxidation treatment solution discharge chambers adjacent said oxidation treatment chamber and on upstream and downstream sides of said oxidation treatment chamber in the direction said uninsulated stranded conductor is passed through said oxidation treatment chamber;

first sealing means provided between one of said discharge chambers and said oxidation treatment chamber; and second sealing means provided between the other of said discharge chambers and said oxidation treatment chamber;

said sealing means substantially preventing the flow of oxidizing solution to the outside of said oxidation treatment chamber without having passed through said stranded conductor being passed through said oxidation treatment chamber.

13. A manufacturing method as claimed in claim 12, wherein said pressure of said oxidation treatment solution in said oxidation treatment chamber is maintained at a gage pressure of about 0.3 $Kg/cm^2$, and wherein the pressure in said discharge chambers is maintained at about atmospheric pressure.

14. A manufacturing method as claimed in any one of claims 1, 2, 3, 4, 5 or 6, wherein in said oxidation treatment step (40) said oxidation treatment solution (48; 404) is sucked through the interstices of the twisted strands in said conductor strand (30) outside said oxidation chamber where said conductor strand (30) is immersed in said oxidation treatment solution (48; 404).

15. A manufacturing method as claimed in claim 8, wherein in said oxidation treatment step (40) said oxidation treatment solution (48; 404) is sucked through the interstices of the twisted strands in said stranded conductor outside said oxidation chamber where said stranded conductor (30) is immersed in said oxidation treatment solution (48; 404).

16. A manufacturing method as claimed in claim 9, wherein in said oxidation treatment step said oxidation treatment solution (48; 404) is sucked through the interstices of the twisted strands in said stranded conductor (30) outside said oxidation chamber where said conductor strand (30) is immersed in said oxidation treatment solution (48; 404).

17. A manufacturing method as claimed in any one of claims 1, 2, 3, 4, 5 or 6, wherein in said oxidation treatment step (40) said oxidation treatment solution is subjected to pressure in said section where said stranded conductor (30) is immersed in said oxidation treatment solution, and outside said oxidation chamber said oxidation treatment solution (48; 404) is sucked through the interstices of the twisted strands in said stranded conductor.

18. A manufacturing method as claimed in claim 8, wherein in said oxidation treatment step said oxidation treatment solution (48; 404) is subjected to pressure in said section where said stranded conductor (30) is immersed in said oxidation treatment solution (48; 404), and outside said oxidation chamber said oxidation treatment solution (48; 404) is sucked through the interstices of the twisted strands in said stranded conductor (30).

19. A manufacturing method as claimed in claim 9, wherein in said oxidation treatment step (40) said oxidation treatment solution (48; 404) is subjected to pressure in said section where said stranded conductor is immersed in said oxidation treatment solution (48; 404), and outside said oxidation chamber said oxidation treatment solution (48; 404) is sucked through the interstices of the twisted strands in said stranded conductor.

20. A manufacturing method as claimed in claim 7, wherein said oxidation treatment solution (48; 404) is heated to its boiling point, or said oxidation treatment solution (48; 404) is heated to a temperature near it or to a temperature near a decomposition temperature of an oxidizing agent in said oxidation treatment solution (48; 404), whichever is lower in the temperature.

21. A manufacturing step as claimed in claim 7, wherein in said oxidation treatment step (40) said stranded conductor immersed in said oxidation treatment solution (48; 404) is heated.

22. A manufacturing method as claimed in claim 7, wherein in said oxidation treatment step said oxidation treatment solution is subjected to pressure in a section where said stranded conductor (30) is immersed in said oxidation treatment solution, said oxidation treatment solution is flowed into the interstices of twisted strands in said stranded conductor, and outside said oxidation chamber said oxidation treatment solution (48; 404) is flowed through the interstices of twisted strands in said stranded conductor.

23. A manufacturing method as claimed in claim 7, wherein in said oxidation treatment step (40) said oxidation treatment solution (48; 404) is sucked through the interstices of the twisted strands in said conductor strand (30) outside said oxidation chamber where said conductor strand (30) is immersed in said oxidation treatment solution (48; 404).

24. A manufacturing method as claimed in claim 7, wherein in said oxidation treatment step (40) said oxidation treatment solution is subjected to pressure in said section where said stranded conductor (30) is immersed in said oxidation treatment solution, and outside said oxidation chamber said oxidation treatment solution (48, 404) is sucked through the interstices of the twisted strands in said stranded conductor.

25. A manufacturing method as claimed in claim 1 or 12, wherein said pressure of said oxidation treatment solution is maintained at a gage pressure of about 0.3 $Kg/cm^2$.

* * * * *

UNITED STATES PATENT AND TRADEMARK OFFICE

CERTIFICATE OF CORRECTION

PATENT NO. : 4,411,710

DATED : October 25, 1983

INVENTOR(S) : Masataka MOCHIZUKI ET AL

It is certified that error appears in the above-identified patent and that said Letters Patent is hereby corrected as shown below:

IN THE TITLE PAGE:

Change the name of the Assignee to

--The Fujikura Cable Works, Limited--.

IN THE TITLE:

Change "CONSTITUTING" to --CONSTITUTED--.

COLUMN 11, line 36, change "manufacture of a conductor" to

--manufacture of a stranded conductor--.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*